US008661998B2

(12) United States Patent
Van Oossanen et al.

(10) Patent No.: US 8,661,998 B2
(45) Date of Patent: Mar. 4, 2014

(54) RUDDER AND SHIP-LIKE OBJECT HAVING SUCH A RUDDER

(75) Inventors: Pieter Van Oossanen, Wageningen (NL); Arie De Jager, Sliedrecht (NL)

(73) Assignees: IHC Holland I.E. B.V. (NL); Van Oossanen & Associates (NL)

( * ) Notice: Subject to any disclaimer, the term of this patent is extended or adjusted under 35 U.S.C. 154(b) by 146 days.

(21) Appl. No.: 13/497,775

(22) PCT Filed: Sep. 20, 2010

(86) PCT No.: PCT/NL2010/050610

§ 371 (c)(1),
(2), (4) Date: Mar. 27, 2012

(87) PCT Pub. No.: WO2011/037457

PCT Pub. Date: Mar. 31, 2011

(65) Prior Publication Data

US 2012/0174849 A1 Jul. 12, 2012

(30) Foreign Application Priority Data

Sep. 25, 2009 (NL) ..... 2003550

(51) Int. Cl.
*B63H 25/06* (2006.01)

(52) U.S. Cl.
USPC ..... 114/163; 114/162; 440/42

(58) Field of Classification Search
USPC ..... 114/162, 163, 126, 332
See application file for complete search history.

(56) References Cited

U.S. PATENT DOCUMENTS

| | | | | |
|---|---|---|---|---|
| 3,181,492 | A * | 5/1965 | Hockett | 114/167 |
| 3,757,720 | A * | 9/1973 | Fischer | 114/332 |
| 3,828,713 | A * | 8/1974 | Duryea | 114/163 |
| 3,931,781 | A * | 1/1976 | Larsh | 114/126 |
| 6,085,680 | A * | 7/2000 | Samuelsen | 114/162 |
| 6,491,554 | B1 * | 12/2002 | Servais | 440/42 |
| 2012/0174849 | A1 * | 7/2012 | Van Oossanen et al. | 114/163 |

FOREIGN PATENT DOCUMENTS

| | | |
|---|---|---|
| EP | 0527270 A | 2/1993 |
| FR | 2531401 A | 2/1984 |
| SU | 485033 A | 9/1975 |

OTHER PUBLICATIONS

International Searching Authority, International Search Report and Written Opinion for PCT/NL2010/050610, Jan. 4, 2011, 9 pages.

* cited by examiner

*Primary Examiner* — Lars A Olson
*Assistant Examiner* — Jovon Hayes
(74) *Attorney, Agent, or Firm* — Meyer IP Law Group

(57) ABSTRACT

The invention relates to a rudder for maneuvering a ship-like object, the rudder comprising a main rudder blade having an upstream end and a downstream end, the rudder being rotatably mountable to the ship-like object around a rotation axis that generally extends in a vertical plane. The main rudder blade extends generally upright. The rudder comprises two generally upright extending auxiliary rudder blades connected to the main rudder blade by transverse plates. At least one of the transverse plates is oriented generally obliquely upwards towards a downstream end. The transverse plates thereby follow the orientation of the flow of water below the upwards receding aft body of the ship.

20 Claims, 4 Drawing Sheets

RUDDER AND SHIP-LIKE OBJECT HAVING SUCH A RUDDER

The invention concerns a rudder for maneuvering a ship-like object and a ship-like object having such a rudder.

Floating objects such as boats and ships have one or more rudders connected thereto for maneuvering and for keeping on course. The rudder is rotatably mounted to the ship-like object and can rotate around a rotation axis, the so called rudder stock.

The rudder comprises a main rudder blade having an upstream and a downstream end. The ship-like object will generally have a forward motion and a flow of water will pass the rudder from the upstream end towards the downstream end. The rudder generally extends vertically upright and in line with the flow of water in a default position. The rudder axis can be tilted with respect to the vertical.

The rotation of the rudder is controlled by a steering wheel or joy stick. Using a suitable transfer mechanism comprising e.g. a transmission and/or actuators, the rudder can be rotated around the rotation axis to exert a side force on the ship-like object, thereby changing its heading.

A rudder having parallel auxiliary blades is known from JP 7165188.

A known problem in maneuvering ship-like objects especially in shallow water, is the increased directional stability. Then a rudder is necessary such that, when rotated, it provides sufficient side force to allow a change in heading. It is an object of the present invention to provide a rudder with improved properties for maneuvering in shallow water.

According to the invention a rudder is provided with a main rudder blade. The rudder is rotatably mountable to the ship-like object around a rotation axis that generally extends in a vertical plane, the main rudder blade extending generally upright, the rudder further comprising at least two generally upright extending auxiliary rudder blades, wherein the auxiliary rudders are connected to the main rudder blade by at least two transverse plates, wherein at least one transverse plate, the upper transverse plate closer to the ship's hull, generally extends obliquely upwardly towards a downstream end thereof. Such a rudder can provide sufficient side forces in shallow water.

The transverse plate is a plate extending mostly in the sideward direction and in the direction of flow. According to the invention this general direction is tilted somewhat such that the transverse plate extends upwardly in the downstream direction. The triple (at least one main and two auxiliary) rudder blades will result in an increased side force during rotation of the rudder, in particular when the rudder is positioned in the slipstream of the operating propeller of the ship-like object.

The rudder is positioned at the stern of the ship-like object. Near the stern the immersion of the hull of the ship will decrease. Water flow toward the stern therefore has an oblique-upward direction. According to the invention the top transverse plate is oriented to follow this line of water flow such that the downstream side is located higher than the upstream side. This will lower the flow resistance force on the rudder.

The inventor calculated flow patterns around the rudder for various hull forms and determined that an adjustment of the angle-of-attack of the top transverse plate would decrease the flow resistance of the rudder, while increasing the side force.

In an embodiment both transverse plates extend obliquely upwards towards downstream ends thereof. However the bottom transverse plate is generally positioned at a smaller angle with respect to the horizontal. Preferably this smaller angle is equal to the local flow direction, such that the angle of attack of the lower transverse plate is generally zero. In an embodiment the lower transverse plate is positioned horizontally.

In an embodiment a top and bottom part of the auxiliary rudder is connected to the transverse plates. Such a rudder has a generally rectangular cross section. By providing a double connection between the main rudder blade and the two auxiliary rudders, a more rigid structure is obtained. In particular, a box-like structure is thereby obtained, increasing the structural integrity of the rudder. This will allow the reduction of the amount of material used for the rudder thus decreasing its weight, while maintaining sufficient stiffness. In an alternative embodiment the rudder comprises three or more transverse plates.

Furthermore the inventor determined from these calculations that it is sometimes advantageous to orient the top plate at a small negative angle-of-attack, relative to the local flow angle. In this way the pressure on the hull above the plate becomes greater, thereby decreasing the resistance of the hull.

In an advantageous embodiment an angle between the top transverse plate and the horizontal plane is between 0.1 and 25 degrees, preferably between 1 and 24 degrees. In a further embodiment this angle is limited to between 4 and 20 degrees. Such an angle allows the top transverse plate to be set at virtually zero angle-of-attack to the local flow direction, thereby ensuring that the resistance force experienced by the rudder is minimal. In an embodiment the angle between the upstream and downstream edge of the main rudder blade and the top transverse plate is between 65 and 89 degrees.

In an embodiment the upper transverse plate, that is the plate closer to the ship's stern, extends more upwardly towards the downstream end (at a greater angle with respect to the horizontal plane) than the lower transverse plate. The water flow closer to the ship's hull, will be more angled with respect to the horizontal plane.

In an embodiment of the rudder according to the invention the transverse plates extend beyond the auxiliary rudder blades in a transverse direction. By providing such an extension, the flow pattern around the rudder is dramatically improved, decreasing the tip vortex of the auxiliary rudder blades, thereby increasing the side force and decreasing the resistance of the rudder. At the downstream end the transverse plates extend past the trailing edge of the rudder blades. This also increases the performance of the rudder.

In an embodiment the ratio between the chord length of the main rudder blade and the width of the transverse plate is between 0.3 and 1.2. The transverse plate can extend somewhat in the upstream and/or downstream direction from the main rudder blade to decrease the strength of any tip vortex occurring at the top and bottom of the rudder blades.

Preferably transverse plates are provided having an edge at an upstream end thereof with a front width extending in the transverse direction. According to an embodiment a ratio between said front width and the chord length of the main rudder is between 0.2 and 0.5.

Preferably the transverse plates are generally of a triangular shape having truncated corners. Such transverse plates will generally have six edges. Preferably the front edge, at the upstream end of the rudder, extends in the transverse direction perpendicular to the direction of the flow of water when the rudder is not at an angle so as to generate side force. Preferably the front edge is a first truncated corner of the triangle in which the planforms of the transverse plates "fit". In a further embodiment two truncated corners are positioned at the transverse extremities of the transverse plates.

The edge of the truncated corner at the transverse extremity of the rudder has a specific length. In an embodiment the ratio between this truncated edge length and the chord length of the main rudder blade is between 0.1 and 0.3.

In an embodiment an upstream end of the auxiliary rudder blade, preferably of both auxiliary rudders, is positioned downstream from the leading edge of the main rudder blade. The position of the auxiliary blades is thus staggered relative to the main rudder blade. This is necessary to avoid that the auxiliary blades become positioned too close to the propeller when the rudder is rotated. Most of the side force will be exerted on the main rudder blade, but as the rudder angle increases, the auxiliary rudder blades will generate considerable side force as well, resulting in a relatively higher total side force, even though the chord length of the auxiliary rudders is smaller.

In an embodiment the chord length of the main rudder blade is between 1.0 and 3.0 of the chord length of the auxiliary rudder blades. In general the chord of the main rudder blade is twice as long as the chord length of the auxiliary rudder blades.

In a further embodiment the leading edge of the auxiliary rudder blades are oriented away from the main rudder blade. The centerlines of the auxiliary rudder blades in plan view, converge when extended downstream. The transverse distance between the upstream end of the auxiliary rudder blades and the main rudder blade is thus larger than the transverse distance at the downstream end. This results in an improved flow pattern, improving the performance of the rudder.

In an embodiment the rudder is positioned close behind the propeller of the ship-like object.

Preferably the angle of said auxiliary rudder blades with respect to the orientation of the main rudder blade is between 0.5 and 12 degrees, in an embodiment 1 and 10 degrees, preferably between 2.0 and 8.0 degrees. The specific value of this angle is configured in combination with properties of the flow the rudder is in.

In an embodiment of the invention, the section shape of the main and auxiliary rudder blades are of the Schilling type. Such foil sections provide for increased lift. Schilling hydrofoils are characterized by having a trailing edge which is thicker than the thickness of the foil just upstream of the trailing edge.

In an embodiment the ratio of the height of the main rudder blade and the chord length of the main rudder is between 1.0 and 4.0, in an embodiment 1.0 and 3.0.

In a further embodiment the transverse distance between the mid plane of the main rudder blade to the respective auxiliary rudder blades is between 0.25 and 1.5 of the chord length of the main rudder blade. Greater values will generally cause the auxiliary rudder blades to be positioned outside of the propeller slipstream which is not advantageous.

According to a further aspect of the invention a ship-like object is preferably fitted with one or more propellers, wherein every propeller is provided with a rudder behind the propeller according to any of the embodiments as disclosed above.

In an embodiment the upward angle of the transverse plate with respect to the horizontal is similar to the angle of the upwards receding aft body of the ship.

According to a further preferred embodiment the upward angle of the top transverse plate depends on the distance between the transverse plate and the receding ship's hull. As the distance is smaller the angle of the transverse plate and receding hull are more similar. If the distance between top transverse plate and receding ship's hull is larger, the angle of the plate with respect to the horizontal is smaller than the receding angle of the ship's hull.

The invention will now be described by referring to the drawing. Specific embodiments of the invention are illustrated, said embodiments are not to be interpreted as limiting the invention, but only as illustrative embodiments disclosing a currently preferred embodiment.

Figure 1:
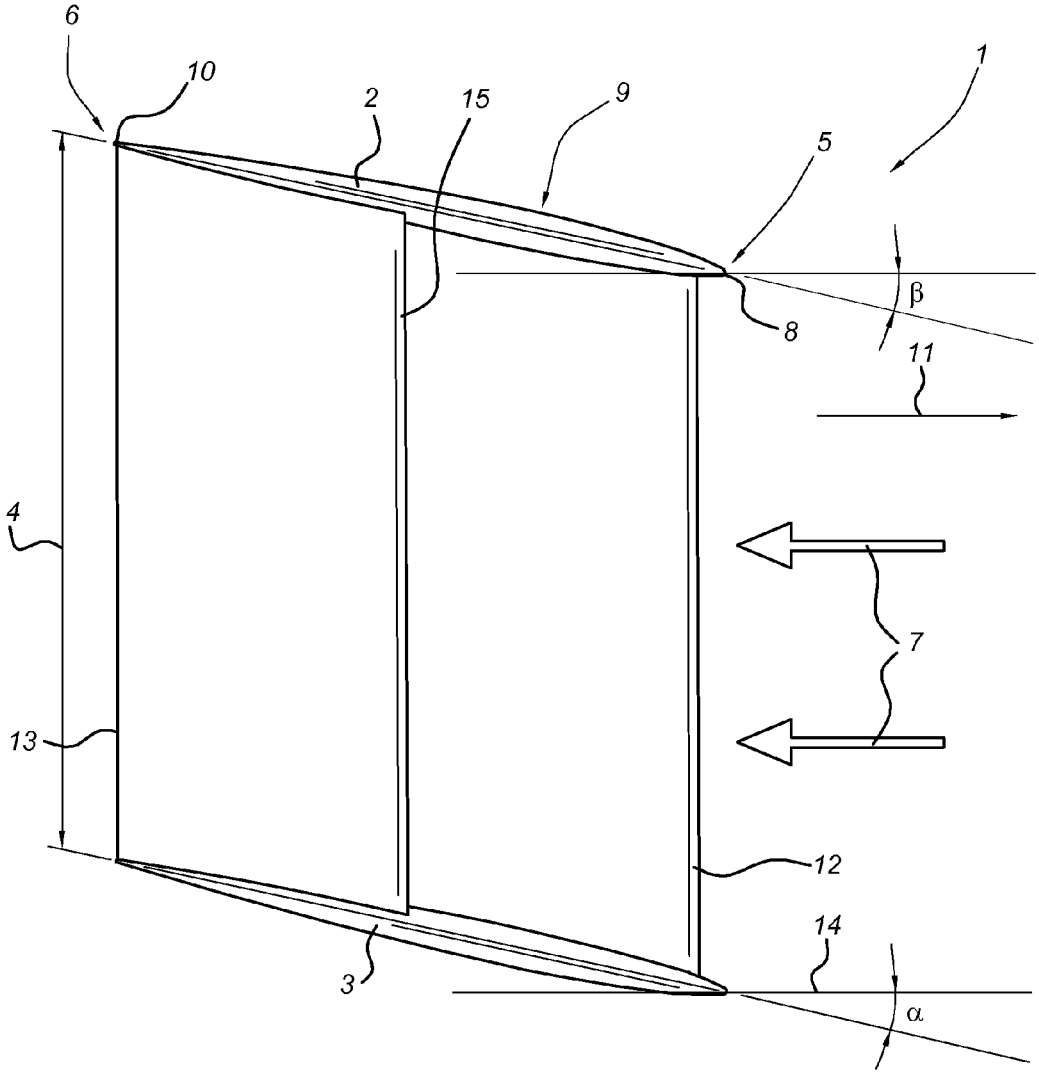
FIG. 1 is a side view of a rudder according to a first embodiment.

FIG. 1 shows a side view of a rudder 1 according to the invention. In accordance with this description the transverse direction is the direction in/out of the paper surface according to FIG. 1. Two transverse plates 2, 3 form end plates of the rudders blades 12,13,23 situated in the vertical plane 4.

The transverse plate has a foil-shape section. At the upstream side 5 the transverse end plate 2 has a leading edge 8. From the leading edge 8, the thickness of plate 2, 3 increases towards 9 and then decreases towards 10 near the downstream end 6.

Between transverse plates 2, 3 a main rudder blade 12 and auxiliary rudder blades 13,23 are fixed. The main rudder blade 12 is fitted closer to the upstream side 5 of the transverse plates 2,3. The upstream end 15 of the auxiliary rudder blade 13 is positioned about halfway downstream from the upstream end 5.

The main rudder blade 12 is connected to the transverse plates 2, 3 from close to the leading edge 8 to the downstream end 10.

Both transverse plates 2, 3 are positioned at an angle with respect to the horizontal plane 14. The transverse plate 3 is positioned at an angle $\alpha$ illustrated in FIG. 1. Transverse plate 2 is positioned at a different angle $\beta$, angle $\beta>\alpha$.

Figure 4:
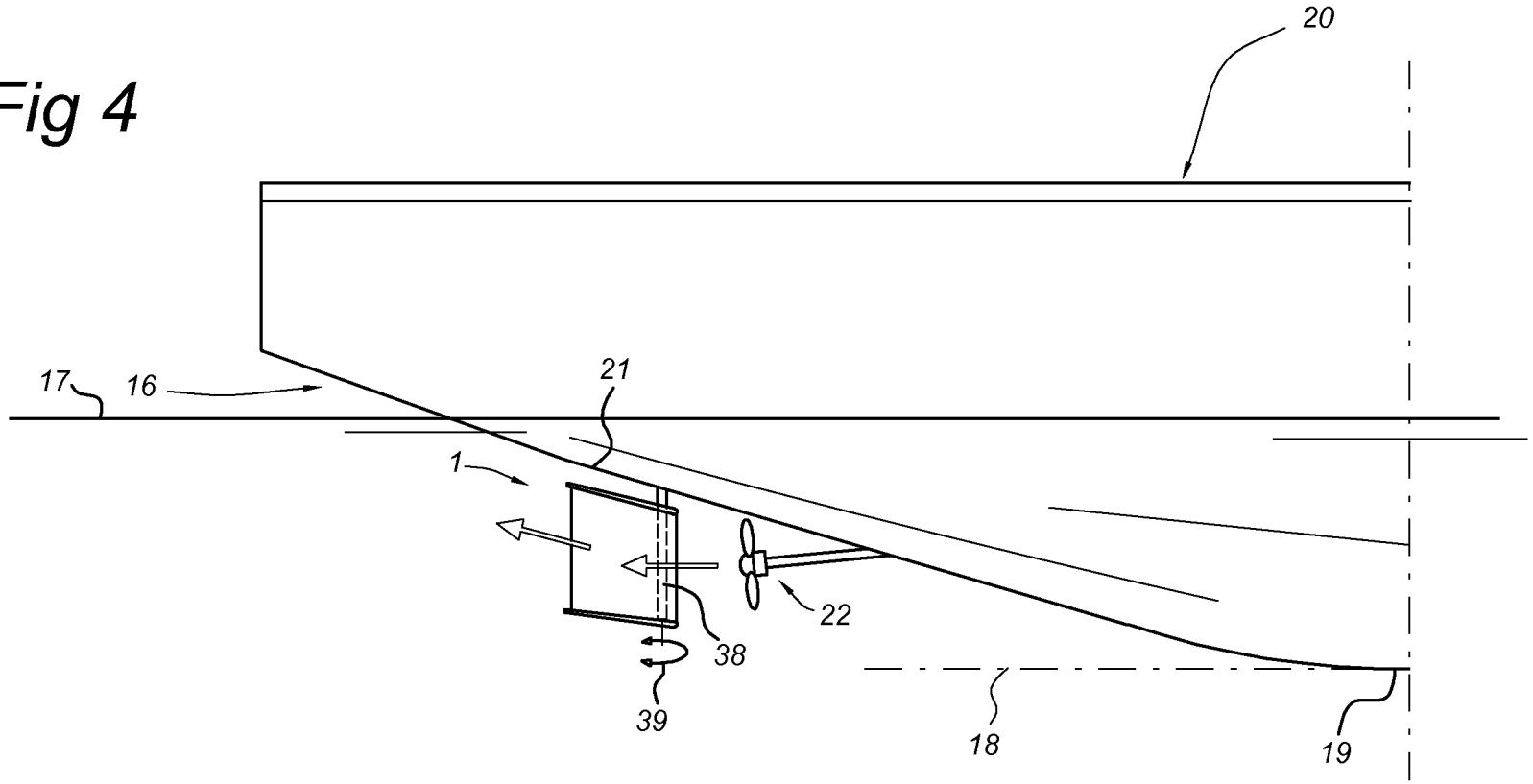
FIG. 4 is an embodiment of a ship-like object comprising the rudder according to the invention.

In FIG. 4 the different angles of the upper and lower transverse plates with respect to the horizontal plane in a longitudinal direction are indicated more explicitly.

A rudder 1 is mounted to a ship-like object 20 near the stern 16. From its maximum draught 18, the bottom 19 of the ship inclines upwards towards the stern 16 of the ship to project above the waterline 17, as shown in FIG. 4.

A rudder is positioned under the inclining line 21 towards the stern 16. It is mounted preferably such that it does not extend under the maximum draught line 18. In this manner the rudder 1 is protected from running into a river bed since the bottom 19 will be lower.

The rudder 1 is mounted to the ship-like object 20 by a shaft 38 that can rotate 39. A control, such as a joystick can be used to actuate a transmission to rotate the shaft and rudder 1 to allow maneuvering of the floating object 20.

Near the stern 16 a propeller 22 is used to propel the ship. It will displace water towards rudder 1 more or less positioned in line downstream from the propeller 22. Other propeller types can be used in combination with the invention.

Because of the shape of the hull of the ship 21 towards the stern 16 water will flow at an inclination to the horizontal. Therefore an upward flow pattern exists near the stern 16.

Transverse plate 2,3 are adapted to this flow pattern. As the transverse plate, as shown in the side views of FIG. 1 and FIG. 4 extends or inclines upwards towards the downstream end 6, the rudder 1 will experience less resistance.

The angle of inclination of the transverse plates is larger for the upper transverse plate 2 as the flow inclination will be more parallel to the (local) hull of the ship. The difference in inclination is between 1 and 24 degrees, preferably between 4 and 20 degrees.

Figure 2:
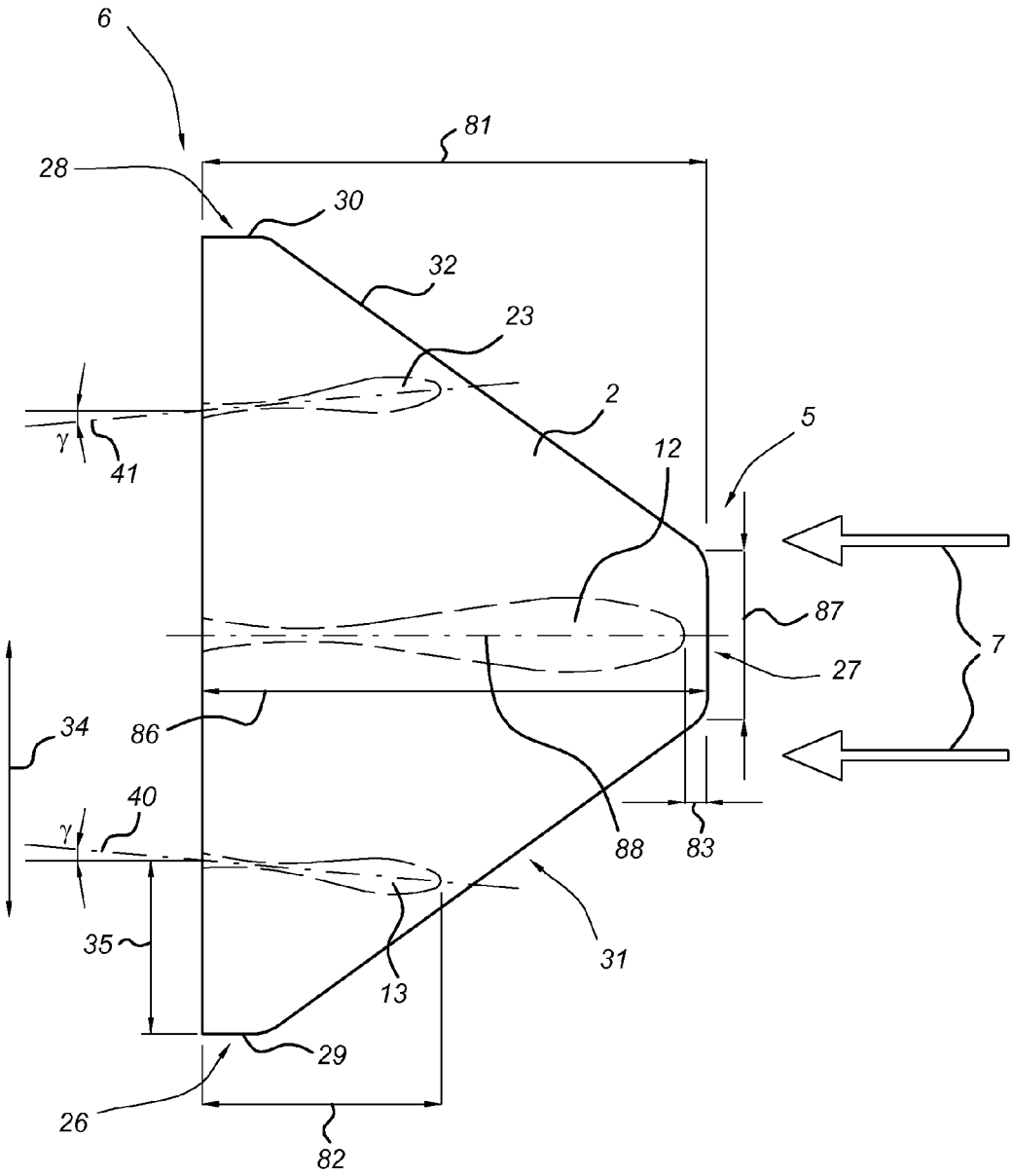
FIG. 2 is a top view of the first embodiment of the rudder.
Figure 3:
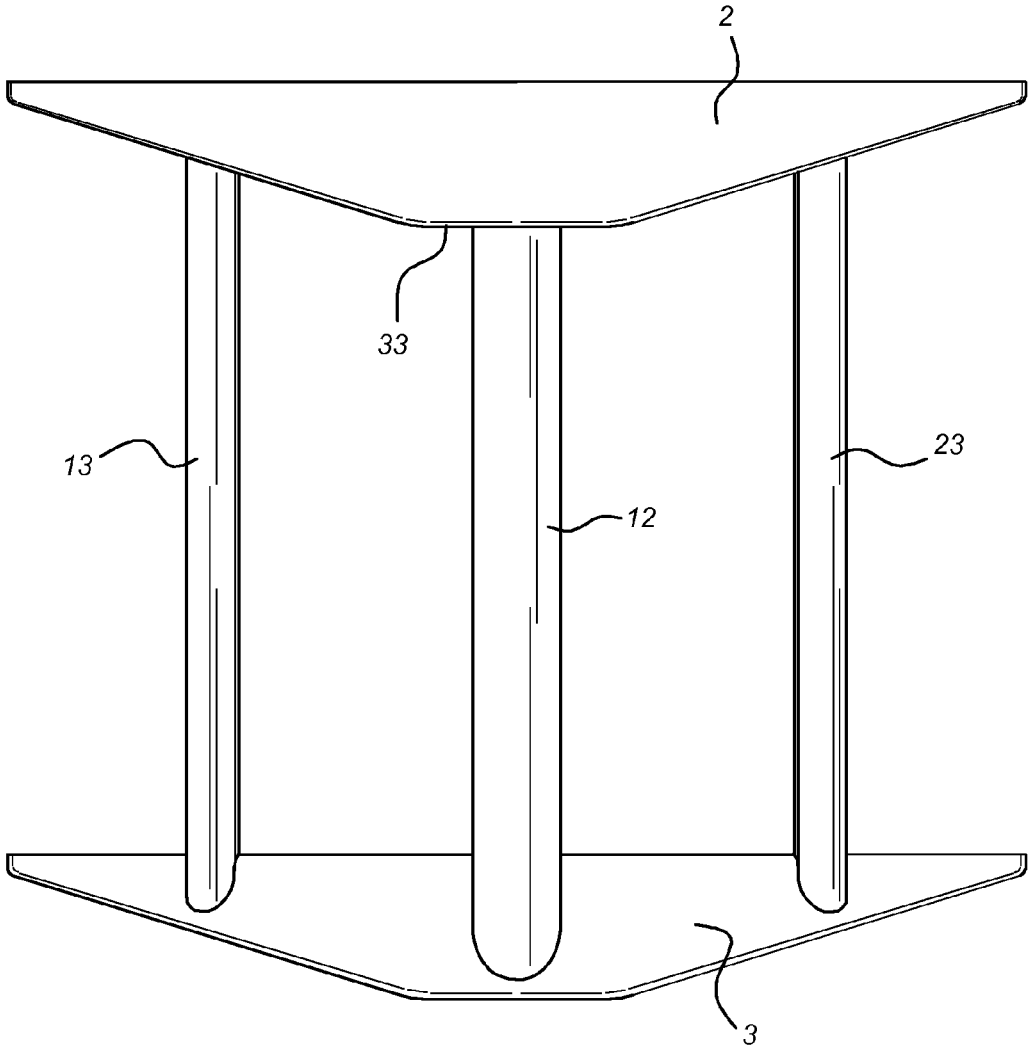
FIG. 3 is a front view of the rudder according to the first embodiment.

FIG. 2 illustrates a top view of rudder 1. The position of the main rudder blade 12 and auxiliary rudder blades 13,23 is shown in FIG. 2. From near the upstream end 5 of each of the blades (main/auxiliary 12,23,13) the blades have a foil-type cross-section. In this embodiment each of the blades is arranged with a Schilling foil section.

Transverse plate 2 is triangular shaped, having truncated corners 26-28. Truncated corner 27 forms a front edge 33 of the plate 2. Truncated corners 26,28 are part of a wing 31,32 extending a distance 35 in the transverse direction 34 outwardly beyond the auxiliary blades 13,23. The edges 29,30 formed at the truncated corners 26,28 extend in the flow direction 7.

The auxiliary rudder blades 13,23 have a centerline 40,41 respectively. The centerlines 40,41 are positioned at an angle-of-attack γ with respect to the centerline of the main rudder blade. The auxiliary rudder blades 13,23 are positioned convergingly with respect to the main rudder blade 12 towards the downstream end 6. The auxiliary rudder blades are thus positioned at a greater transverse distance from the main rudder blade at the upstream end 5 than at the downstream end 6.

The angle-of-attack γ (0-12 degrees) is configured as a result of considerations relating to reducing flow separation on the auxiliary rudder blades at moderate and large rudder angles.

In the default position and in particular if the propeller 22 is used, water will be propelled towards the rudder 1. As a result of the propelling action the water will show a converging flow pattern. The auxiliary rudder blades are positioned in accordance to this flow pattern, thereby reducing the resistance of the auxiliary rudder blades in the default position.

The main rudder blade has a height 4 in the upright direction between the transverse end plates 2,3. The top plate 2 has a length 81 in the direction of flow. The auxiliary rudder blades 13,23 have a chord length 82 in the direction of flow.

The top plate 2 extends a length 83 upstream beyond the leading edge 5 of the main rudder blade 12.

The chord length 86 of the main rudder blade 12 is indicated in FIG. 2. FIG. 2 also shows the width 87 at the upstream end of the transverse plate 2. Further, FIG. 2 shows the centerline 88 of the main rudder blade 12.

Although the transverse plates 2,3 are indicated as a single plate connecting the main rudder blade 12 to both auxiliary rudder blades 13,23, it is possible according to an embodiment of the invention to have three or four separate plates for making more than three or four connections between the main rudder blade 12 and the auxiliary rudder blades 13,23.

The invention claimed is:

1. A rudder (1) for maneuvering a vessel (20), the rudder (1) comprising:

a main rudder blade (12) having an upstream end (5) and a downstream end (6), the rudder (1) being rotatably mountable to the vessel around a rotation axis (38), the rudder (1) further comprising two generally upright extending auxiliary rudder blades (13, 23) connected to the main rudder blade (12) by at least two transverse plates (2, 3), wherein at least one of the transverse plates (2, 3) is oriented generally obliquely upwards towards a downstream end (6), wherein the two transverse plates (2, 3) are connected to a top and bottom end respectively of the auxiliary rudder (13, 23) and/or the main rudder blade (12), wherein a top transverse plate (2), positioned above a bottom transverse plate (3), extends more obliquely upwards towards the downstream end (6) than the bottom transverse plate (3).

2. The rudder according to claim 1, wherein a single transverse plate (2, 3) connects two auxiliary rudders (13, 23) to the main rudder.

3. The rudder according to claim 1, wherein two transverse plates (2, 3) extend obliquely upwards towards the downstream end (6).

4. The rudder according to claim 1, wherein an angle between the transverse plate (2, 3) and a horizontal plane (14) is between 0.1 and 25 degrees.

5. The rudder according to claim 1, wherein the transverse plate (2, 3) extending mostly in a flow direction (7) and transverse direction (34), extends beyond the auxiliary rudder (13, 23) in the transverse direction (34).

6. The rudder according to claim 5, wherein a ratio between a chord length of the main rudder blade (12) and a length (35) of the transverse plate (2, 3) extending beyond the auxiliary rudders (13, 23) is between 0.3 and 1.2.

7. The rudder according to claim 1, wherein a ratio between a width (87) of the transverse plate (2, 3) at an upstream end (5) thereof and a chord length (86) of the main rudder blade (12) is between 0.2 and 0.5.

8. The rudder according to claim 1, wherein the transverse plate (2, 3) is triangular in shape, having truncated corners (26, 27, 28).

9. The rudder according to claim 8, wherein the truncated corners (26, 27, 28) are positioned at ends of the transverse plates extending in the transverse direction (34) beyond the auxiliary rudder blade (13, 23).

10. The rudder according to claim 8, wherein the ratio of a length of an edge (29, 30) formed at said truncated corners (26, 28) and a chord length (86) of the main rudder blade (12) is between 0.1 and 0.3.

11. The rudder according to claim 1, wherein an upstream end (5) of the auxiliary rudder blade (13, 23) is positioned downstream from the upstream end (5) of the main rudder blade (12).

12. The rudder according to claim 1, wherein a chord length (86) of the main rudder blade (12) is between 1.0 and 3.0 of a chord length (82) of the auxiliary rudder blades (13,23).

13. The rudder according to claim 1, wherein the auxiliary rudder blades (13, 23) are positioned at an angle-of-attack with respect to the main rudder blade (12) with a leading edge of the auxiliary blades (13, 23) rotated away (40) from the main rudder blade (12).

14. The rudder according to claim 13, wherein the angle-of-attack setting of the auxiliary rudder blades (13, 23) with respect to the main rudder blade (12) is between 0.5 and 12 degrees.

15. The rudder according to claim 1, wherein any of the main rudder blade (12) or auxiliary blades (13, 23) are composed of Schilling rudder foil sections.

16. The rudder according to claim 1, wherein a ratio of a height (4) of the main rudder blade (12) and a chord length (86) of the main rudder blade (12) is between 1.0 and 4.0.

17. The rudder according to claim 1, wherein a ratio of a transverse distance between a centerline (88) of the main rudder blade and the auxiliary rudder blades (13, 23) is between 0.25 and 1.5 of a chord length of the main rudder blade (12).

18. The rudder according to claim 1, wherein the rotation axis generally extends in a vertical plane, the main rudder blade (12) extending generally upright.

19. A vessel having an assembly of a propeller and a rudder according to claim 1.

20. The vessel according to claim 19, having a top transverse plate (2) extending at an angle (R) obliquely upwards, wherein said angle (R) is dependent of a distance between a hull of the and the top transverse plate (2).

* * * * *